United States Patent [19]

Lewis

[11] Patent Number: 4,579,027

[45] Date of Patent: Apr. 1, 1986

[54] APPARATUS AND METHOD FOR CUTTING AND UNBONDING ELASTIC BANDS

[75] Inventor: Paul A. Lewis, Salinas, Calif.

[73] Assignees: Robert Alameda; Richard Cooper, both of Salinas, Calif.

[21] Appl. No.: 651,275

[22] Filed: Sep. 14, 1984

[51] Int. Cl.[4] ..... B26D 7/06

[52] U.S. Cl. ..... 83/28; 83/157; 83/277; 83/282; 83/636; 83/922; 83/925 EB; 225/2; 225/101

[58] Field of Search ..... 83/19, 20, 27, 28, 42, 83/102, 152, 157, 237, 257, 277, 282, 390, 454, 461, 636, 639, 659, 925 EB, 922, 373, 596, 212.1, 23

[56] References Cited

U.S. PATENT DOCUMENTS

| | | | |
|---|---|---|---|
| 2,742,087 | 4/1956 | Smith et al. | 83/157 X |
| 3,410,161 | 11/1968 | Roch | 83/282 X |
| 3,842,699 | 10/1974 | Zyl | 83/157 |
| 4,060,015 | 11/1977 | Gros | 83/54 X |

*Primary Examiner*—James M. Meister
*Assistant Examiner*—John L. Knoble
*Attorney, Agent, or Firm*—Manfred M. Warren; Robert B. Chickering; Glen R. Grunewald

[57] ABSTRACT

An elastic band cutting apparatus is disclosed which includes a movable blade mounted proximate an elastic band stock holding structure for displacement to effect cutting of the tubular stock. The apparatus also includes a movable anvil which cooperates with the blade to engage the cut elastic bands so as to grip the same between the blade and anvil. After cutting is completed, one of the anvil and blade are displaced with respect to the blade so as to break any bonds which have formed during the shearing process. The apparatus further includes stock feeding assembly which will advance the stock to the cutter and eject previously cut and separated bands onto band manipulating apparatus. A method for cutting and separating elastic bands also is disclosed.

14 Claims, 8 Drawing Figures

APPARATUS AND METHOD FOR CUTTING AND UNBONDING ELASTIC BANDS

BACKGROUND OF THE INVENTION

The present invention relates, in general, to the formation of elastic bands and, more particularly, relates to the cutting of elastic bands from tubular band stock and the unbonding or separating of the sides or cut edges of the bands after cutting.

Elastic or rubber bands are formed from various combinations of synthetic and natural rubbers and filler materials. The fillers are used to provide the elastic bands with a variety of properties, and more particularly, they also are used to control the elasticity or elongation of the bands. Generally, as the percentage of fillers increase, the band elasticity decreases, and conversely the most elastic of the elastic bands are virtually entirely formed from synthetic or natural rubber.

While there are many applications in which a highly elastic, (e.g., 300 to 800 percent elongation) elastic band is desirable, there are serious problems in the formation and manipulation of such bands. Most typically, elastic bands are cut from tubular elastic band stock having a diameter equal to the desired band length in the relaxed condition. Cutting can be effected by a fly cutter, particularly for narrow widths, or a scissors-type of cutter.

In prior art elastic band cutting apparatus the bands are usually simply cut and then collected. Thus, the cutting apparatus merely deposits the bands in a jumble in a collecting bin with a random orientation. For bands which have a high degree of elastomeric compounds, the cutting process also often bonds or welds the opposite sides of the bands together. This bonding is particularly common for the scissor-type of cutting apparatus.

Attempts have been made to try to separate the bonded edges of elastic bands. One approach is simply agitation of the jumbled collection of cut bands. Another approach is to employ suction apparatus which engages and vacuum grips opposite sides of the bonded band during or immediately after the cutting process. The vacuum gripping units are then separated while the vacuum is applied to attempt to pull the sides of the bands apart and break the bonds created during cutting.

Such vacuum unbonding apparatus has been found to have limited effectiveness. First, it is best employed with relatively wide elastic bands. Second, the vacuum is often broken before the bond between the cut edges of the band is broken. Lastly. after separation, the bands are usually deposited in a collector in random orientations so that subsequent use of the bands requires a band sorting and orienting apparatus.

While apparatus have been evolved for the extraction of individual rubber bands from a randomly oriented collection of rubber bands, such apparatus usually severely limit the speed with which bands can be applied to an end use. Thus, cutting apparatus typically produces cut elastic bands much faster than band sorting and orienting apparatus can extract and orient bands from a pile of randomly oriented bands. The problems of sorting and orienting bands become even more severe as the band width decreases and as the band elasticity increases.

OBJECTS AND SUMMARY OF THE INVENTION

A. Objects of the Invention

Accordingly, it is an object of the present invention to provide a method and apparatus for cutting and unbonding elastic bands which is particularly well suited for use with elastic bands having a high degree of elasticity.

It is another object of the present invention to provide a method and apparatus for cutting elastic bands which controls orientation of the bands for immediate use in band applying equipment.

A further object of the present invention is to provide elastic band cutting apparatus which is capable of high production and yet produces open elastic bands which may be output in a predetermined orientation onto band applying equipment.

Still another object of the present invention is to provide an elastic band cutting and unbonding method which is fast and effective.

Other objects of the present invention are to provide an apparatus and method for cutting and unbonding elastic bands which is durable, reliable in operation, employs a minimum number of moving parts, is easy to maintain, is economical to construct and operate and can be integrated for use with a wide range of auxilliary equipment.

The elastic band cutting and unbonding apparatus and method of the present invention have other objects and features of advantage which will be apparent from or are set forth in more detail in the accompanying drawing and following description of the preferred embodiment.

B. Summary of the Invention

The elastic band cutting apparatus includes stock holding means, cutting means having a movable blade mounted for displacement proximate the holding means to effect cutting of the stock, and band gripping means mounted proximate the movable blade and formed to grip bands as they are cut from the stock. The improvement in the band cutting apparatus comprises, briefly, the gripping means including anvil means movably mounted in substantial alignment with the movable blade and biased toward the blade to grip cut bands between the blade and the anvil. The anvil is further displaceable by the blade in the direction of movement of the blade during cutting and preferably is laterally displaceable relative to the blade to cooperate with the blade to slide the opposite cut edges of the band longitudinally in opposite directions to break any bond occuring during cutting.

The improved method of separating bonded together edges of cut elastic bands comprises, briefly, engaging opposite sides of the cut elastic band with band engaging means, and displacing the sides in opposite directions to shift the bonded edges with respect to each other to break the bonds.

The apparatus further preferably includes band stock feeding means formed to feed stock to the stock holding means and cutting blade and operated to eject cut bands from the apparatus from separation. Band applying apparatus positioned proximate the cutting blade is formed to receive cut bands after separation so as to enable their use while the band orientation is still controlled.

DESCRIPTION OF THE PREFERRED EMBODIMENT

Figure 1:
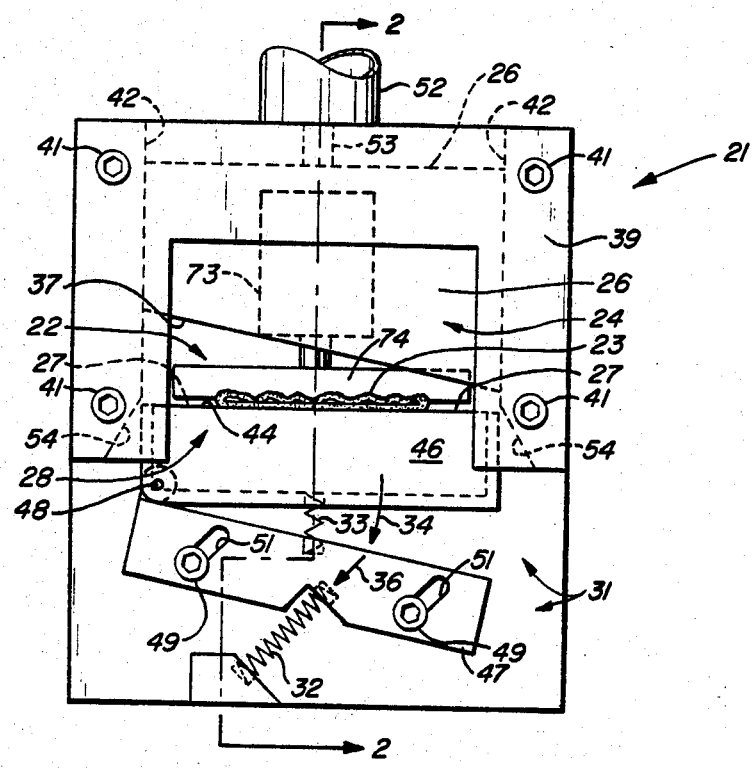
FIG. 1 is a front elevation view of an elastic band cutting and unbonding apparatus constructed in accordance with the present invention.
Figure 2:
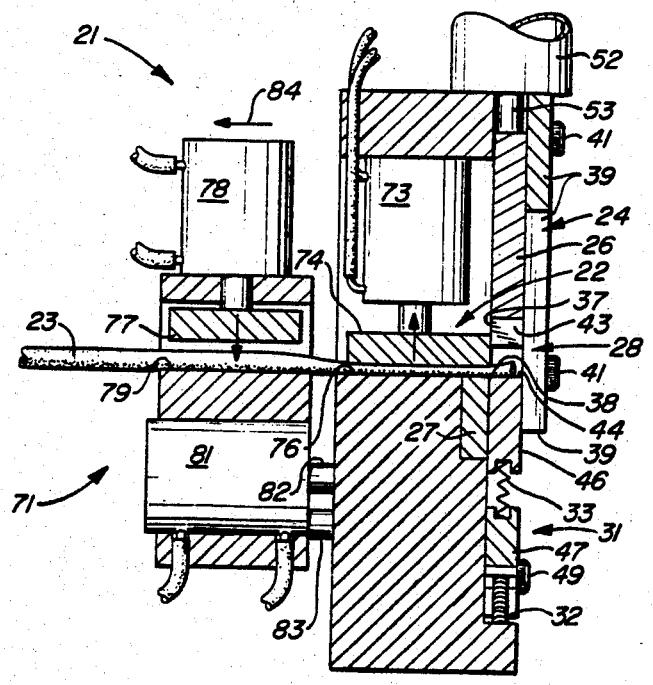
FIG. 2 is a side elevation view, in cross-section, taken substantially along a plane in line 2—2 of FIG. 1.

Referring now to FIGS. 1 and 2, the elastic band cutting and separating apparatus of the present invention, generally designated 21, can be seen to include holding means 22 formed to grip and hold tubular elastic band stock 23. Reciprocally mounted proximate and in front of holding means 22 is a cutting means, generally designated 24, including movable blade 26 and fixed blade 27. The elastic band cutting apparatus of the present invention further includes gripping means, generally designated 28, mounted proximate movable blade 26 and formed to grip elastic bands as they are cut from stock 23.

Prior art elastic band cutting apparatus, particularly of the scissors-type, has included apparatus as broadly described above. The cutting apparatus of the present invention, however, is formed to enable gripping and control of the elastic band after it is cut from the tubular stock and is further formed to enable breaking of the bond which typically forms between the opposed cut edges of the elastic bands so that the bands can be opened and immediately transferred to a band manipulating or applying device. Thus, the band cutting apparatus of the present invention is constructed so as to control the elastic band after it is cut and open it up and deposited on a band applying device so that the need for sorting and separating equipment to separate and orient the bands from a pile of randomly oriented bands is eliminated.

In order to effect gripping of elastic bands so that they can be controlled during the cutting process and thereafter, the apparatus of the present invention is formed with gripping means that includes anvil means, generally designed 31, mounted to band cutting apparatus 21 in substantial alignment with movable blade 26, as best may be seen in FIG. 2. Anvil means 31 is biased, for example, by resilient spring biasing elements 32 and 33, toward movable blade 26 to engage and grip elastic bands between the movable blade and anvil 31. Additionally, the anvil means 31 of the apparatus of the present invention is displaceable by and in a direction of movement of blade 26, as indicated by arrows 34 and 36, while the anvil and blade grip the bands during cutting.

As will be seen, the cutting apparatus of the present invention preferably includes a guillotine-shaped cutting blade 26 in which the sloped inner edge 37 that progressively shears down across cutting edge 38 of the second or fixed blade 27 so as to shear elastic bands from stock 23. Movable blade 26 is slidably mounted to the blade cutting apparatus by an inverted U-shaped guide plate 39 which is mounted by fasteners 41 to the apparatus and includes a blade guide channel 42 in which blade 26 slidably moves. Both of blades 26 and 27 are preferably formed of high strength alloy steels which will maintain the cutting edges 37 and 38 in a sharp condition which will effect shearing of the elastic band stock.

In order to enable gripping with anvil 31, movable blade 26 preferably includes a substantially planar surface 43 which extends parallel to the longitudinal axis of stock 23 so that surface 43 and an upwardly facing surface 44 on anvil element 46 will engage opposed sides of the elastic bands as it is sheared from stock 23. As will be seen, it is preferable that anvil surface 44 be positioned at about the same height or somewhat below the upper surface of second or fixed blade 27. This positioning affords immediate support for the band as it is being cut by movable blade 26 and insures ejection of cut bands, as will be described in more detail hereafter. It has been found, however, that positioning anvil surface 44 below the top surface of fixed blade 27 is also acceptable in that the movable blade will urge the cut band down against the anvil before the individual band is completely severed from the band stock and cut bands will still be ejected upon advancement of the stock for the next cut.

In order to allow direct use of elastic bands which are cut by the cutting apparatus of the present invention in band applying or manipulating devices, the cutting apparatus of the present invention further includes a structure which will break the bonds which typically occur between the opposed edges of the bands as a result of shearing. As the elasticity of the tubular stock 23 increases, the tendency of the cutting process to weld bond adjacent edges of the band together during cutting increases. As can be seen in FIG. 1, various portions along the length of band stock 23 are bonded together as a result of the previous cut of the tubular stock. Attempts have been made in the prior art to separate these sections or open the band up by using vacuum gripping apparatus which pull the cut band apart. Such apparatus, however, is only effective if it can maintain a good vacuum with the band, which limits the use of the vacuum apparatus to bands having a substantial width dimension. The elastic band cutter of the present invention is intended for use in cutting bands down to and below a sixteenth of an inch in width, making use of vacuum gripping apparatus extremely difficult and relatively ineffective. Even for wide bands, the tendency is for the vacuum to break and the apparatus not to be reproducibly effective in breaking the bonds which occur.

Separation of the bands and breaking of the bonds is accomplished in the cutting apparatus of the present invention by forming one of anvil means 31 and movable blade 26 for movement in a direction along cutting edge 37 of the movable blade while gripping the bands to laterally displace the cut, adjacent, side edges of the bands sufficiently to break any bonding of these edges caused during cutting. In the preferred form shown in the drawing, anvil means 31 is mounted for movement in a direction along cutting edge 37 of the movable blade. Such lateral movement can be accomplished by forming the anvil means as a slide plate assembly including first slide plate 46 positioned to engage the band with surface 44 and a second slide plate 47 mounted on the remote side of slide plate 46 with respect to blade 26 and stock 23. First slide plate 46 is pivotally mounted at 48 to the second slide plate and the second slide plate is slidably mounted to apparatus 21 by means of pins 49 which slidably pass through slots 51 in the second slide plate.

Figure 3:
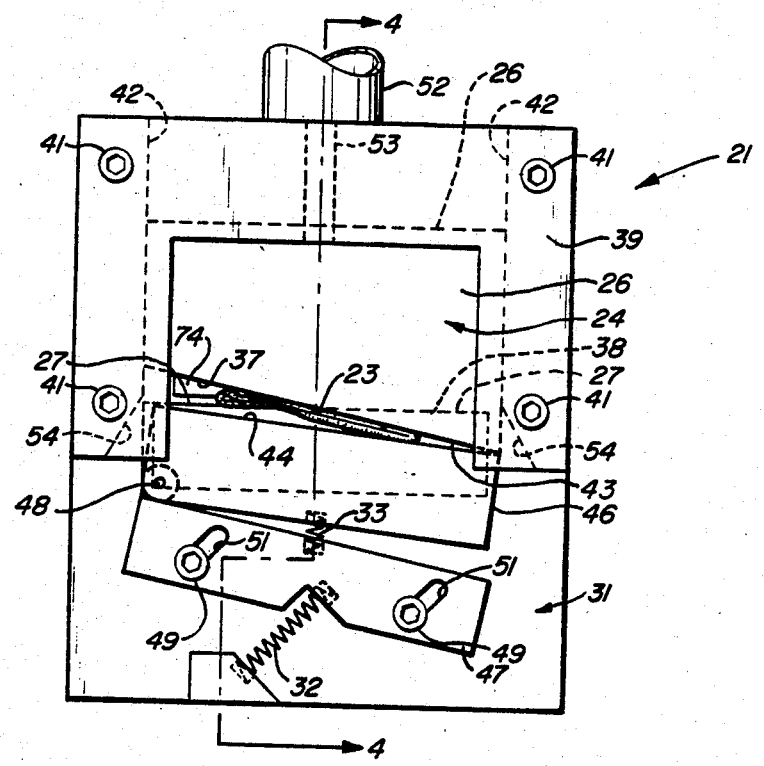
FIG. 3 is a front elevation view corresponding to FIG. 1 with the cutting blade shown in a moved position.
Figure 4:
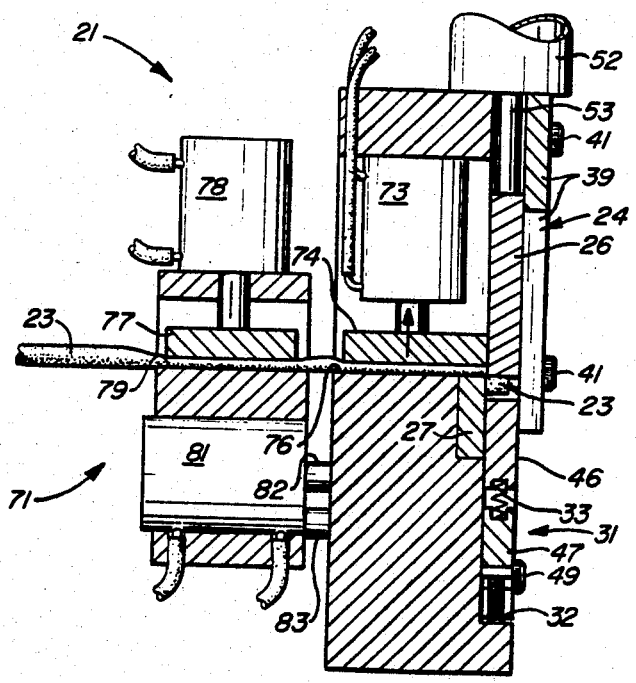
FIG. 4 is a side elevation view in cross-section, taken substantially along the plane of line 4—4 in FIG. 3.

Operation of the anvil means or assembly 31 to produce a lateral displacement which will break the bonds between adjacent edges of the cut bands can best be understood by following the cutting process from the position shown in FIGS. 1 and 2 through the positions shown in FIGS. 3–6. In FIG. 3, movable blade 26 can be seen to have cut proximately one-half of an elastic band from stock 23. As will be seen, pneumatic or hydraulic actuator 52 has displaced piston 53, and thus cutting blade 26, downwardly until the sloped edge 37 has passed across the upper edge 38 of the fixed or second blade 27. This downward displacement urges the cut band against upper surface 44 of first anvil plate 46, which has been downwardly displaced against biasing spring 33 about pivot point 48. As shown in FIG. 3, therefore, the right end of the cut rubber band is being gripped between surfaces 43 and 44 of the blade and anvil, respectively, and the anvil has been angularly displaced to an angle more closel conforming to the slope of cutting edge 37. Front guide plate 39 is relieved at 54 to permit pivoting of anvil plate 46. As shown in FIGS. 3 and 4, the anvil and blade are merely gripping the cut portion of the band. There has been no lateral displacement or movement to effect unbonding or separation of the cut edges of the band.

Figure 5:
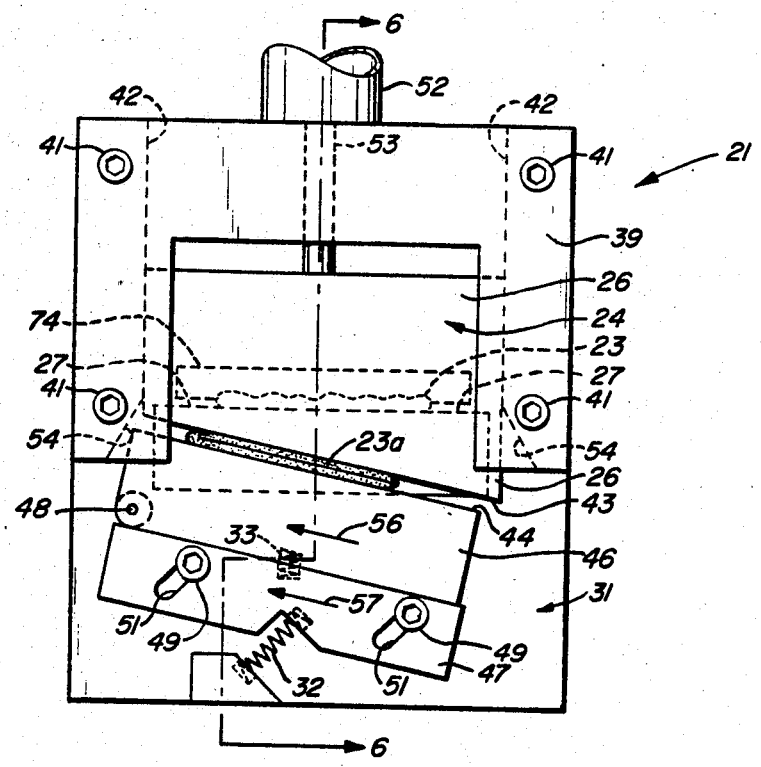
FIG. 5 is a front elevation view corresponding to FIGS. 1 and 3 with the cutting blade in a further moved position.
Figure 6:
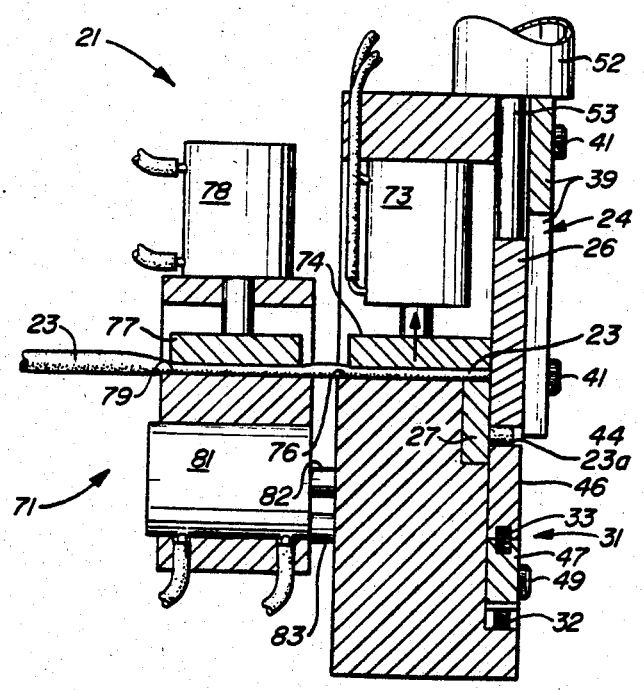
FIG. 6 is a side elevation view, in cross-section, taken substantially along the plane of line 6—6 in FIG. 5.

In FIGS. 5 and 6, movable blade 26 has cut completely through tubular stock 23 to produce a cut band **23*a*. Pivotal anvil member 46 has pivoted about 48 to a position in which band engaging surface 44 is substantially parallel to blade surface 43 with the cut band 23*a* gripped between the anvil and the movable blade. Additionally, slide plate 47 has been displaced downwardly against spring 32, with the result that the slots 51 (preferably at an acute angle with respect to the direction of motion of blade 26) and pins 49 have produced a lateral shifting of entire anvil assembly 31, as indicated by arrows 56 and 57. The lateral shift of the anvil assembly causes cut band 23*a* to have its opposite edges shifted in opposite longitudinal directions along the band. The band 23*a* is, in effect, rolled along its length between the anvil and the cutting blade to thereby break any bonds which may have occurred during the shearing process on both sides of band 23*a*. In FIG. 5 band 23*a* is shifted to the left of stock 23**, and the sliding-rolling between the anvil and the blade is highly effective in breaking any of the synthetic or natural rubber bonding produced by the shearing action of the blade.

As will be appreciated, it is an advantage of the present invention that the lateral displacement is effected by a downward displacement of blade 26. Thus, the actuator 52 can be used to not only drive the blade through the band, but shift the anvil so as to cause separtion of the edges of the cut band. It is also possible, however, to drive anvil means 31 by an independent actuator, to laterally displace blade 26 by means of guide channels and/or an independent actuator or a combination of motion of the movable blade and anvil in opposite directions.

Figure 7:
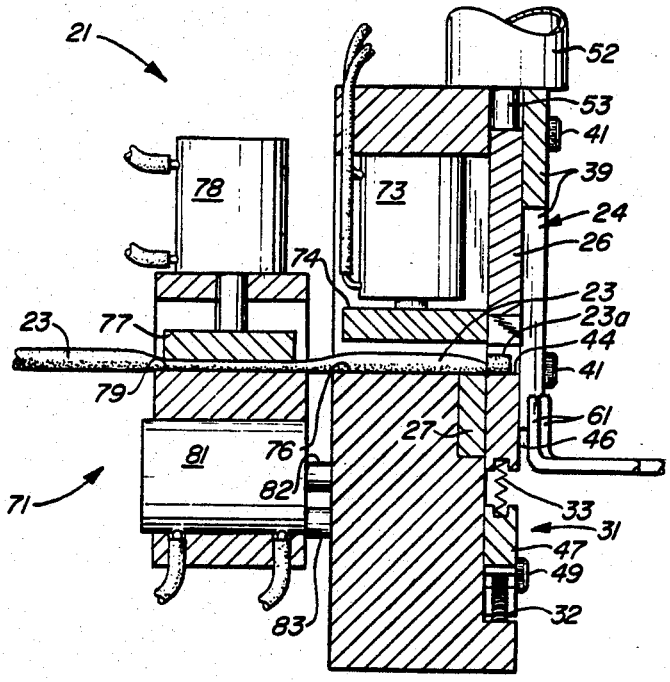
FIG. 7 is a side elevation view, in cross-section, corresponding to FIG. 6 with the cutting apparatus in a further moved position showing completion of cutting of the band.
Figure 8:
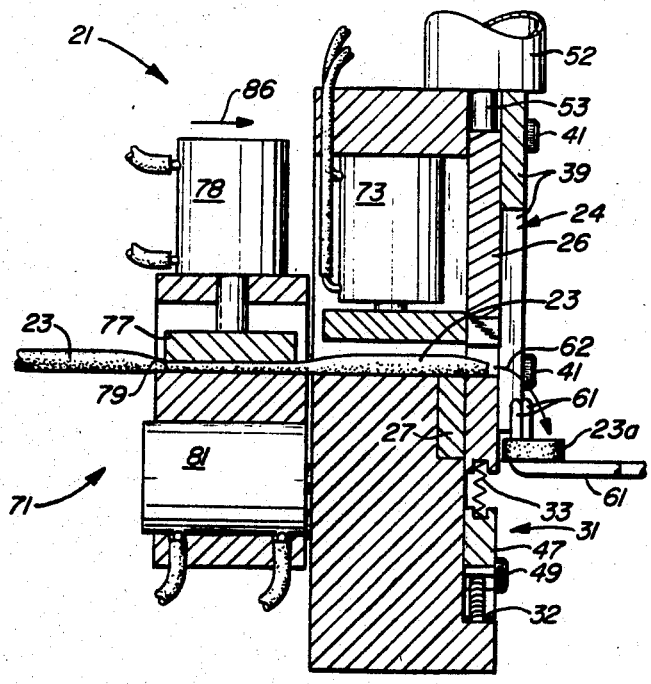
FIG. 8 is a side elevation view, in cross-section, corresponding to FIG. 7 with the cutting apparatus in a further moved position showing ejection of the cut band onto the manipulating apparatus.

After shifting of the cut band **23*a* in a lateral direction to produce separation of the band edges, movable blade 26 is retracted to the position as shown in FIGS. 1 and 7, with the result that anvil plate 46 and 47 return to their original position with the cut band 23*a* separated or opened up, as shown in FIG. 7, and resting on upper surface 44 of anvil and slide plate 46. Also shown in FIG. 7 are a plurality of fingers 61 positioned proximate and below a surface 44 of anvil and slide plate 46. As will be more fully described hereinafter, the elastic band stock can be axially advanced (FIG. 8) to eject cut band 23*a*, as indicated by arrow 62, down over fingers 61**, which fingers can be a part of a band manipulating or applying apparatus that will, for example, expand the band and place it over a product or bundle of products. Such band expanding and applying apparatus is more fully set forth in my co-pending application entitled "Elastic Band Application System" and will not be described in detail herein.

Thus, from the time of shearing of the elastic band from stock 23 until its positioning on elastic band manipulating apparatus, the cutting apparatus of the present invention controls the orientation of the bands and thus enables the elimination of sorting apparatus of the kind which would be required to extract bands from a randomly oriented pile of bands.

The elastic band cutting apparatus in the present invention further includes stock feeding means, generally designated 71, and shown in FIGS. 2, 4, 6, 7 and 8. Stock feeding means 71 is mounted proximate stock holding means 22 and is formed for periodic advancement of the elastic band stock to the holding means. In FIG. 2, holding means 22 can be seen to include an actuator 73 which drives a clamping plate 74 to press the stock against platform surface 76 and the upper surface of fixed blade 27.

Feeding means 71 also preferably includes a clamping plate 77 driven by actuator 78 that will clamp stock 23 down against support surface 79, but which is shown in a raised position in FIG. 2. In order to reciprocate feeding assembly 71, a second actuator 81 with drive piston 82 is provided so that the entire feeding assembly can be displaced on guide rails 83 to provide a reciprocating carriage suitable for advancement of the stock. As shown in FIG. 2, the clamping plate 77 is open and the entire assembly has been reciprocated to the left, as shown by arrow 84, so as to be in a position for clamping against the stock to advance the same. In FIGS. 4 and 6, clamping plate 77 has been clamped down against the stock so as to grip the same. In FIG. 7 the holding plate 74 has been moved upwardly so as to free the stock for axially displacement, and in FIG. 8, the entire carriage has been displaced to the right as indicated by arrow 82, to a position proximate the cutter so as to advance the stock and eject the cut band **23*a*. As will be apparent, it is possible to maintain the feeding assembly 71 in a position of FIG. 8, rather than FIG. 2**, during the band shearing process and then to reciprocate the carriage away from the cutter, clamp the stock, and shuttle the carriage back to the cutter so as to advance the stock.

As will be understood, the stroke of actuator 81 can readily be varied so as to change the width dimension of band **23*a***. Using apparatus constructed in accordance with the present invention bands have been cut down to a width of 3/64 inches (1.2 millimeters). Wide bands, of course, are even easier to cut.

The elastic band cutting method of the present invention includes the steps of holding band stock 23, cutting an individual band 23*a* from the stock, releasing the stock and advancing the band to enable cutting of another band. These steps, however, are common to the prior art, and the improvement in the band cutting method of the present invention is comprised of gripping the band as it is cut between movable blade 27 and anvil means 31. Additionally, the present method includes the steps of cutting the band by shearing and displacing opposed cut edges of band 23*a* longitudinally in opposite directions with respect to each other to break the bonds between the edges which are caused during the shearing step. Finally, the present method includes the step of releasing and ejecting the band from between the movable blade and anvil directly onto band manipulating means 61.

What is claimed is:

1. A method of cutting an elastic band from tubular elastic band stock and unbonding opposite sides of the cut band including the steps of holding said stock with opposite sides pressed into abutting relation, cutting an individual band from said stock by a cut across said stock with cutting means including a movable blade and anvil means movably mounted in alignment with and resiliently biased toward said blade, and gripping said band after cutting with gripping means wherein the improvement in said method comprises:

during said gripping step, engaging said band with said sides of said band in abutting relation, and shifting said gripping means to produce displacement of at least one of said opposite sides relative to a remainder of said opposite sides of said band in a direction along said cut over a distance sufficient to break any bonds between said abutting sides of said band.

2. The method of cutting an elastic band as defined in claim 1 wherein, said cutting step is accomplished by shearing said band from said stock with said movable blade, said gripping step is accomplished during said cutting step by urging movable anvil means against one side of the band while said movable blade is urged against and engages an opposite side of said band, and shifting step is accomplished by shifting one of said movable blade and said anvil means relative to the remainder thereof.

3. Apparatus for cutting an elastic band from tubular stock and unbonding opposite sides of the cut band including, stock holding means formed to hold said stock for cutting with opposed sides in abutting relation, cutting means mounted proximate said holding means and having a movable blade mounted for displacement transversely across said stock to cut a band therefrom with opposite band sides in abutting relation, and band gripping means mounted proximate said movable blade and formed to grip said band as said band is cut from said stock, wherein the improvement in said apparatus comprises:

said gripping means being formed for displacing at least one of said band sides relative to the other band side in a direction along the length of the cut made by said cutting means after said band is cut from said stock a sufficient distance to break any bonding between said band sides resulting from cutting of said band.

4. The apparatus as defined in claim 3 wherein, said gripping means includes anvil means movably mounted to said apparatus in substantial alignment with and biased toward said movable blade, said movable blade having a cutting edge extending transversely across said stock and said movable blade and said anvil means being formed to cooperatively grip said band therebetween; and one of said anvil means and said movable blade is further mounted for movement in a direction along said cutting edge of said movable blade while gripping said band to laterally displace the cut adjacent said edges of said band sufficiently to break any bonding together of said edges caused during cutting.

5. The apparatus as defined in claim 4 wherein, said anvil means is mounted for movement in a direction along said cutting edge of said movable blade.

6. The apparatus as defined in claim 5 wherein, said anvil means is provided by a reciprocally mounted slide plate assembly resiliently biased toward said blade.

7. The apparatus as defined in claim 6 wherein, said slide plate assembly includes a first slide plate positioned to engage siad bands and a second slide plate mounted on the remote side of said first slide plate from said movable blade.

8. The apparatus as defined in claim 7 wherein, said first slide plate is pivotally mounted to said second slide plate, and said second slide plate is slidably mounted to said apparatus for lateral displacement relative to said movable blade upon displacement by said movable blade.

9. The apparatus as defined in claim 3 wherein, said movable blade is formed with a laterally sloped movable cutting edge and a band engaging surface outwardly of said cutting edge, and said movable blade being mounted for sliding reciprocal movement proximate said holding means;

said cutting means includes a fixed blade having a fixed cutting edge positioned to cooperate with said movable cutting edge to effect cutting, said fixed blade having a stock engaging surface inwardly of said fixed cutting edge positioned opposite said holding means to cooperate in holding said stock for cutting;

said gripping means includes anvil means movably mounted to said apparatus in substantial alignment with and biased toward said movable blade, said anvil means further includes a slide plate assembly slidably mounted proximate said fixed blade and having a band engaging surface facing said band engaging surface on said movable blade; and one of said anvil means and said movable blade being mounted for movement along the band relative to the remainer of said movable blade and said anvil means to produce relative movement of said band engaging surfaces along said band and thereby effect separation of bonded together edges of the cut bands after cutting from the stock.

10. The apparatus as defined in claim 9 wherein, said band engaging surface on said movable blade and on said anvil means are substantially planar and have substantially the same width dimension, and said slide plate assembly includes a first slide plate and a second slide plate, said first slide plate being pivotally coupled to said second slide plate and being biased away from said second slide plate, and said second slide plate being slidably mounted to said apparatus and resiliently biased toward said movable blade.

11. The apparatus as defined in claim 10 wherein, said second slide plate is mounted for sliding movement at an acute angle with respect to the axis of movement of said movable blade.

12. The apparatus as defined in claim 9, and stock feeding means formed to advance said stock to said holding means upon release of gripping of said bands by said movable blade and said anvil means and upon release of said stock by said holding means to thereby eject the cut bands from said gripping means.

13. The apparatus as defined in claim 12, wherein, said stock feeding means is provided by a movable carriage having an adjustable stroke enabling variation of the width of the elastic bands cut from the stock.

14. The apparatus as defined in claim 9, and band manipulating means positioned proximate said anvil means for receipt of bands upon release of gripping between said movable blade and said anvil means.

* * * * *